US011282451B2

(12) United States Patent
Yin

(10) Patent No.: US 11,282,451 B2
(45) Date of Patent: Mar. 22, 2022

(54) PIXEL DRIVING CIRCUIT, PIXEL CIRCUIT, DISPLAY DEVICE, AND DRIVING METHOD THEREOF

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 510 days.

(21) Appl. No.: 16/345,146

(22) PCT Filed: Oct. 26, 2018

(86) PCT No.: PCT/CN2018/112006
§ 371 (c)(1),
(2) Date: Apr. 25, 2019

(87) PCT Pub. No.: WO2019/114429
PCT Pub. Date: Jun. 20, 2019

(65) Prior Publication Data

US 2021/0366387 A1 Nov. 25, 2021

(30) Foreign Application Priority Data

Dec. 15, 2017 (CN) ..... 201711348064.0

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0852* (2013.01); *G09G 2320/0233* (2013.01)

(58) Field of Classification Search
CPC ..... G09G 3/3233; G09G 3/3291
(Continued)

(56) References Cited

U.S. PATENT DOCUMENTS 7,382,340 B2 6/2008 Kim et al.
9,679,517 B2 6/2017 Gu et al.
(Continued)

FOREIGN PATENT DOCUMENTS

CN 1909046 A 2/2007
CN 101283393 A 10/2008
(Continued)

OTHER PUBLICATIONS

China First Office Action, Application No. 20171138064.0, dated Mar. 17, 2020, 26 pps.: with English translation.
(Continued)

*Primary Examiner* — Calvin C Ma
(74) *Attorney, Agent, or Firm* — Armstrong Teasdale LLP

(57) ABSTRACT

Embodiments of the present disclosure provide a pixel driving circuit. The pixel driving circuit includes a reset circuit, a compensation and data-in circuit, a drive transistor, and a light-emitting control circuit. The reset circuit is configured to reset a voltage of a control electrode of the drive transistor according to a first and third control signals. The compensation and data-in circuit is configured to receive a reference signal from the data line according to the first control signal, receive a data signal from the data line according to a second control signal, and apply a compensation voltage to the control electrode of the drive transistor based on the reference signal, the data signal, and a voltage of the first voltage terminal. The light-emitting control circuit is configured to control the light-emitting device to emit light according to a third control signal.

20 Claims, 6 Drawing Sheets

(58) Field of Classification Search
USPC ..... 345/174, 204
See application file for complete search history.

(56) References Cited

U.S. PATENT DOCUMENTS

| | | | | |
|---|---|---|---|---|
| 2007/0279337 | A1 | 12/2007 | Kim et al. | |
| 2008/0170004 | A1* | 7/2008 | Jung | G09G 3/3233 345/76 |
| 2012/0007848 | A1 | 1/2012 | Han et al. | |
| 2015/0378470 | A1* | 12/2015 | Yang | G06F 3/0412 345/174 |

FOREIGN PATENT DOCUMENTS

| | | | |
|---|---|---|---|
| CN | 103839520 | A | 6/2014 |
| CN | 103927975 | A | 7/2014 |
| CN | 204029330 | U | 12/2014 |
| CN | 104361857 | A | 2/2015 |
| CN | 104809989 | A | 7/2015 |
| CN | 105575331 | A | 5/2016 |
| CN | 106409227 | A | 2/2017 |
| CN | 108447446 | A | 8/2018 |
| CN | 108665852 | A | 10/2018 |
| JP | 2008292786 | A | 12/2008 |

OTHER PUBLICATIONS

China Second Office Action, Application No. 20171138064.0, dated Jul. 29, 2020, 19 pps.: with English translation.
China Third Office Action, Application No. 20171138064.0, dated Jan. 13, 2021, 26 pps.: with English translation.
European Extended Search Report, Application No. 18867321.4, dated Jul. 27, 2021, 17 pps.
PCT International Search Report, Application No. PCT/CN2018/112006, dated Jan. 21, 2019, 5 pages: with English translation.
PCT Written Opinion, Application No. PCT/CN2018/112006, dated Jan. 21, 2019, 8 pages.: with English translation of relevant part.

* cited by examiner

PIXEL DRIVING CIRCUIT, PIXEL CIRCUIT, DISPLAY DEVICE, AND DRIVING METHOD THEREOF

CROSS REFERENCE TO RELATED APPLICATIONS

This patent application is a National Stage Entry of PCT/CN2018/112006 filed on Oct. 26, 2018, which claims the benefit and priority of Chinese Patent Application No. 201711348064.0 filed on Dec. 15, 2017, the disclosures of which are incorporated by reference herein in their entirety as part of the present application.

BACKGROUND

The present disclosure relates to the field of display technologies, and more particularly, to Organic Light Emitting Diode (OLED) pixel driving circuit, and driving method thereof, pixel circuit, display substrate, display device, and driving method thereof.

In the current OLED array substrate, by changing a gate voltage of a drive transistor that directly drives an OLED to emit light, the magnitude of a current between a source of the drive transistor and a drain of the drive transistor is controlled so as to achieve a change in the luminance of the light. Due to the manufacturing process factors, the threshold voltages Vth of the amorphous silicon thin film transistor (TFT), the low temperature polysilicon and the oxide semiconductor TFT devices are different from one another. That is to say, there is a large difference among the threshold voltages Vth of the drive transistors in different pixel circuits. This results in the display brightness difference of two adjacent pixel circuits which can be seen by the human eye, even if the input luminance data of the two adjacent pixel circuits are the same. The display brightness difference may be known as the brightness unevenness in a small area similar to the hourglass phenomenon.

The OLED is driven by current to emit light. The greater the drive current, the brighter the illumination. When the light-emitting diodes in the pixel circuit powered by the same power supply line ELVDD are illuminated, the current passing through the light-emitting diode at the beginning of the power supply line ELVDD has the maximum value. Then the current will be decreased when passing through every subsequent pixel circuit. Thus, a voltage drop is generated on the power supply line ELVDD, that is, the difference between the supply voltage of the first row of pixel circuits and the supply voltage of the last row of pixel circuits are relatively large. This causes the display brightness to gradually become brighter or darker even if the same brightness data is input. This is the so-called ELVDD voltage drop (IR drop).

BRIEF DESCRIPTION

Embodiments described herein provide pixel driving circuit, and driving method thereof, pixel circuit, display substrate, display device, and driving method thereof.

A first aspect of the present disclosure provides a pixel driving circuit. The pixel driving circuit includes a reset circuit, a compensation and data-in circuit, a drive transistor, and a light-emitting control circuit. The reset circuit is coupled to a first control terminal, a control electrode of the drive transistor, and a second electrode of the drive transistor, and is configured to reset a voltage of the control electrode of the drive transistor, according to a first control signal from the first control terminal and a third control signal from a third control terminal. The compensation and data-in circuit is coupled to a data line, the first control terminal, a second control terminal, the control electrode of the drive transistor, and a first voltage terminal, and is configured to receive a reference signal from the data line according to the first control signal, receive a data signal from the data line according to a second control signal from the second control terminal, and apply a compensation voltage to the control electrode of the drive transistor based on the reference signal, the data signal, and a voltage of the first voltage terminal. The control electrode of the drive transistor is coupled to the compensation and data-in circuit. A first electrode of the drive transistor is coupled to the first voltage terminal. The second electrode of the drive transistor is coupled to the light-emitting control circuit. The light-emitting control circuit is coupled to a light-emitting device and the third control terminal, and is configured to control the light-emitting device to emit light according to the third control signal.

In some embodiments of the present disclosure, the reset circuit includes a first transistor. A control electrode of the first transistor is coupled to the first control terminal. A first electrode of the first transistor is coupled to the second electrode of the drive transistor. A second electrode of the first transistor is coupled the control electrode of the drive transistor.

In some embodiments of the present disclosure, the compensation and data-in circuit includes a second transistor, a third transistor, a first capacitor, and a second capacitor. A control electrode of the second transistor is coupled to the first control terminal. A first electrode of the second transistor is coupled to the data line. A second electrode of the second transistor is coupled to a first terminal of the first capacitor and a first terminal of the second capacitor. A control electrode of the third transistor is coupled to the second control terminal. A first electrode of the third transistor is coupled to the data line. A second electrode of the third transistor is coupled to the first terminal of the second capacitor. A second terminal of the first capacitor is coupled to the control electrode of the drive transistor. A second terminal of the second capacitor is coupled to the first voltage terminal.

In some embodiments of the present disclosure, the light-emitting control circuit includes a fourth transistor. A control electrode of the fourth transistor is coupled to the third control terminal. A first electrode of the fourth transistor is coupled to the light-emitting device. A second electrode of the fourth transistor is coupled to the second electrode of the drive transistor.

In some embodiments of the present disclosure, the reference signal is provided by the data line in a blanking interval.

A second aspect of the present disclosure provides a pixel driving circuit. The pixel driving circuit includes a drive transistor, a first transistor, a second transistor, a third transistor, a fourth transistor, a first capacitor, and a second capacitor. A control electrode of the drive transistor is coupled to a second electrode of the first transistor and a second terminal of the first capacitor. A first electrode of the drive transistor is coupled to a first voltage terminal and a second terminal of the second capacitor. A second electrode of the drive transistor is coupled to a first electrode of the first transistor and a second electrode of the fourth transistor. A control electrode of the first transistor is coupled to a first control terminal. A control electrode of the second transistor is coupled to the first control terminal. A first electrode of the second transistor is coupled to a data line. A second electrode of the second transistor is coupled to a first terminal of the first capacitor and a first terminal of the second capacitor. A control electrode of the third transistor is coupled to a second control terminal. A first electrode of the third transistor is coupled to the data line. A second electrode of the third transistor is coupled to the first terminal of the second capacitor. A control electrode of the fourth transistor is coupled to a third control terminal. A first electrode of the fourth transistor is coupled to a light-emitting device.

In some embodiments of the present disclosure, the data line is configured to receive a reference signal and a data signal in different intervals.

In some embodiments of the present disclosure, a current flowing through the drive transistor when the light-emitting device is emitting light is expressed as:

$$I = K\left[\frac{C1 \times C2}{C1 \times C2 + C2 \times C3 + C3 \times C1}(Vdata - Vref)\right]^2$$

where I represents the current flowing through the drive transistor, K represents a current constant associated with the drive transistor, C1 represents a capacitance value of the first capacitor, C2 represents a capacitance value of the second capacitor, C3 represents a capacitance value of a parasitic capacitor of the drive transistor, Vdata represents a voltage value of a data signal from the data line, and Vref represents a voltage value of a reference signal from the data line.

In some embodiments of the present disclosure, the drive transistor, the first transistor, the second transistor, the third transistor, and the fourth transistor are P-type transistors.

A third aspect of the present disclosure provides a pixel circuit. The pixel circuit includes the pixel driving circuit according to the first and second aspects of the present disclosure and a light-emitting device. The pixel driving circuit is connected to one terminal of the light-emitting device and is configured to drive the light-emitting device to emit light. Another terminal of the light-emitting device is connected to a second voltage terminal.

In some embodiments of the present disclosure, the light-emitting device includes an organic light-emitting diode.

A fourth aspect of the present disclosure provides a display substrate. The display substrate includes a plurality of gate lines and a plurality of data lines, and a plurality of pixel circuits according to the third aspect of the present disclosure, which are arranged in an array. Each of the gate lines is coupled to a second control terminal of the respective pixel circuit.

A fifth aspect of the present disclosure provides a display device. The display device includes the display substrate according to the fourth aspect of the present disclosure.

A sixth aspect of the present disclosure provides a driving method for driving the pixel driving circuit according to the second aspect of the present disclosure. In the driving method, a reference signal is inputted to the data line, and a first compensation voltage, associated with a voltage of the first voltage terminal, a threshold voltage of the drive transistor, and the reference signal, is generated in the compensation and data-in circuit. A data signal is inputted to the data line, a second voltage is inputted to the second control terminal, and a first voltage is inputted to the first control terminal, such that a third voltage associated with the voltage of the first voltage terminal and the data signal is generate in the compensation and data-in circuit. The second voltage is inputted to a third control terminal and the first voltage is inputted to the second control terminal, such that the light-emitting device is driven to emit light based on the voltage of the first voltage terminal, the first compensation voltage, and the third voltage.

In some embodiments of the present disclosure, in the step of inputting the reference signal to the data line, and generating, in the compensation and data-in circuit, the first compensation voltage, the reference signal is inputted to the data line, the second voltage is inputted to the first control terminal and the third control terminal, such that the voltage of the control electrode of the drive transistor is reset. Next the second voltage is inputted to the first control terminal, and the first voltage is inputted to the third control terminal, such that the first compensation voltage is generated in the compensation and data-in circuit.

In some embodiments of the present disclosure, in the blanking interval, the reference signal is input to the data line, and the first compensation voltage is generated in the compensation and data-in circuit.

In some embodiments of the present disclosure, the voltage of the control electrode of the drive transistor is reset to a voltage smaller than a difference between the voltage of the first voltage terminal and an absolute value of the threshold voltage of the drive transistor.

A seventh aspect of the present disclosure provides a driving method for driving the display device according to the fifth aspect of the present disclosure. In the driving method, a reference signal is inputted to the data lines of all rows of the pixel circuits simultaneously. Next, the respective data signals are inputted to the data lines of all rows of the pixel circuits sequentially. Then the light-emitting devices of all rows of the pixel circuits are driven to emit light simultaneously. The light-emitting device is driven to emit light for less than a half of a time period for scanning one frame of image.

In some embodiments of the present disclosure, the time period for scanning one frame of image includes three different intervals: a blanking interval, a data-in interval, and a light-emitting interval. In the blanking interval, the reference signal is simultaneously inputted to the data lines of all rows of the pixel circuits. In the data-in interval, the respective data signals are sequentially inputted to the data lines of all rows of the pixel circuits. In the light-emitting interval, the light-emitting devices of all rows of the pixel circuits are driven to emit light simultaneously.

BRIEF DESCRIPTION OF THE DRAWINGS

To describe technical solutions of the embodiments of the present disclosure more clearly, the accompanying drawings of the embodiments will be briefly introduced in the following. It should be known that the accompanying drawings in the following description merely involve some embodiments of the present disclosure, but do not limit the present disclosure, in which.

DETAILED DESCRIPTION

To make the technical solutions and advantages of the embodiments of the present disclosure clearer, the technical solutions in the embodiments of the present disclosure will be described clearly and completely below, in conjunction with the accompanying drawings in the embodiments of the present disclosure. Obviously, the described embodiments are merely some but not all of the embodiments of the present disclosure. All other embodiments obtained by those skilled in the art based on the described embodiments of the present disclosure without creative efforts shall fall within the protecting scope of the present disclosure.

Unless otherwise defined, all terms (including technical and scientific terms) used herein have the same meaning as commonly understood by those skilled in the art to which present disclosure belongs. It will be further understood that terms, such as those defined in commonly used dictionaries, should be interpreted as having a meaning that is consistent with their meaning in the context of the specification and will not be interpreted in an idealized or overly formal sense unless expressly so defined herein. As used herein, the description of "connecting" or "coupling" two or more parts together should refer to the parts being directly combined together or being combined via one or more intermediate components.

In all the embodiments of the present disclosure, a source and a drain (an emitter and a collector) of a transistor are symmetrical, and a current from the source to the drain (from the emitter to the collector) to turn on an N-type transistor is in an opposite direction with respect to the current from the source to the drain (from the emitter and the collector) to turn on an a P-type transistor. Therefore, in the embodiments of the present disclosure, a controlled intermediate terminal of the transistor is referred to as a control electrode, a signal input terminal is referred to as a first electrode, and a signal output terminal is referred to as a second electrode. The transistors used in the embodiments of the present disclosure mainly are switching transistors. In addition, terms such as "first" and "second" are only used to distinguish one element (or a part of the element) from another element (or another part of this element).

Figure 1:
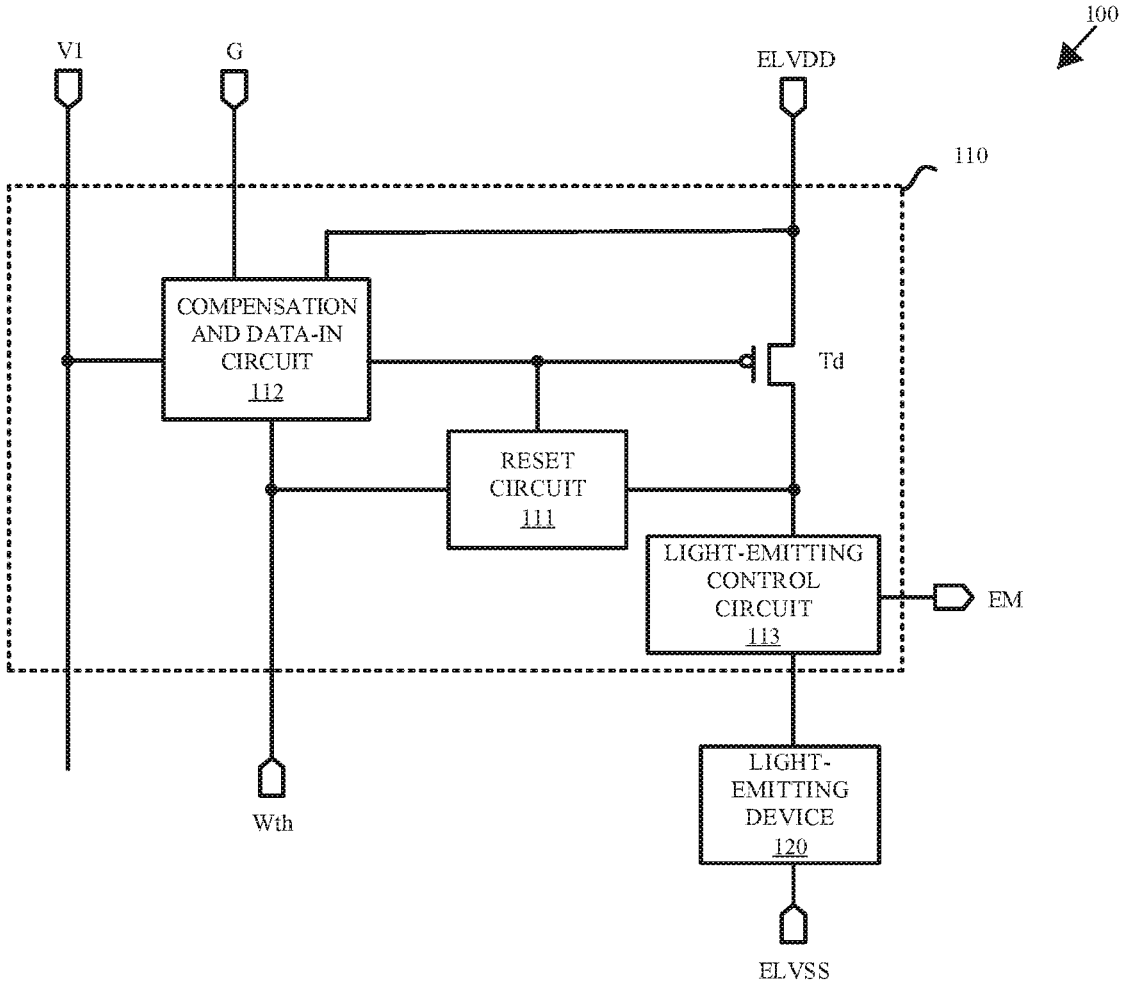
FIG. 1 is a schematic block diagram of a pixel circuit according to an embodiment of the present disclosure.

FIG. 1 shows a schematic block diagram of a pixel circuit 100 according to an embodiment of the present disclosure. As shown in FIG. 1, the pixel circuit 100 may include a pixel driving circuit 110 and a light-emitting device 120. The pixel driving circuit 110 may be coupled to one terminal of the light-emitting device 120 and may be configured to drive the light-emitting device 120 to emit light. The other terminal of the light-emitting device 120 may be coupled to a second voltage terminal ELVSS.

The pixel driving circuit 110 may include a reset circuit 111, a compensation and data-in circuit 112, a drive transistor Td, and a light-emitting control circuit 113. The reset circuit 111 may be coupled to a first control terminal Wth, a control electrode of the drive transistor Td, and a second electrode of the drive transistor Td. The reset circuit 111 may be configured to reset a voltage of the control electrode of the drive transistor Td, according to a first control signal from the first control terminal Wth and a third control signal from a third control terminal EM.

The compensation and data-in circuit 112 may be coupled to a data line V1, the first control terminal Wth, a second control terminal G, the control electrode of the drive transistor Td, and a first voltage terminal ELVDD. The compensation and data-in circuit 112 may be configured to receive a reference signal Vref from the data line V1 according to the first control signal, receive a data signal Vdata from the data line V1 according to a second control signal from the second control terminal G, and apply a compensation voltage to the control electrode of the drive transistor Td based on the reference signal Vref, the data signal Vdata, and a voltage of the first voltage terminal ELVDD. The compensation voltage can be used to compensate for the threshold voltage difference of the drive transistor Td and the voltage drop along the power supply line (i.e., the first voltage terminal ELVDD).

The control electrode of the drive transistor Td may be coupled to the compensation and data-in circuit 112. The first electrode of the drive transistor Td may be coupled to the first voltage terminal ELVDD. The second electrode of the drive transistor Td may be coupled to the light-emitting control circuit 113, and may be configured to provide a current corresponding to a voltage between the first electrode of the drive transistor Td and the control electrode of the drive transistor Td.

The light-emitting control circuit 113 may be coupled to the second electrode of the drive transistor Td, the light-emitting device 120, and the third control terminal EM. The light-emitting control circuit 113 may be configured to control, according to the third control signal from the third control terminal EM, the light-emitting device 120 to emit light according to the current provided by the drive transistor Td.

The compensation and data-in circuit 112 in the pixel driving circuit according to an embodiment of the present disclosure can compensate for a threshold voltage difference of the drive transistor Td in the pixel driving circuit and a voltage drop along the power supply line (i.e., the first voltage terminal ELVDD), thereby avoiding the brightness difference of the light-emitting diodes on the array substrate. In addition, the data signal and the reference signal may be provided through the data line during different time periods, so there is no need to arrange a reference signal line in addition to the data line, thereby saving the layout space of the display panel.

Figure 2:
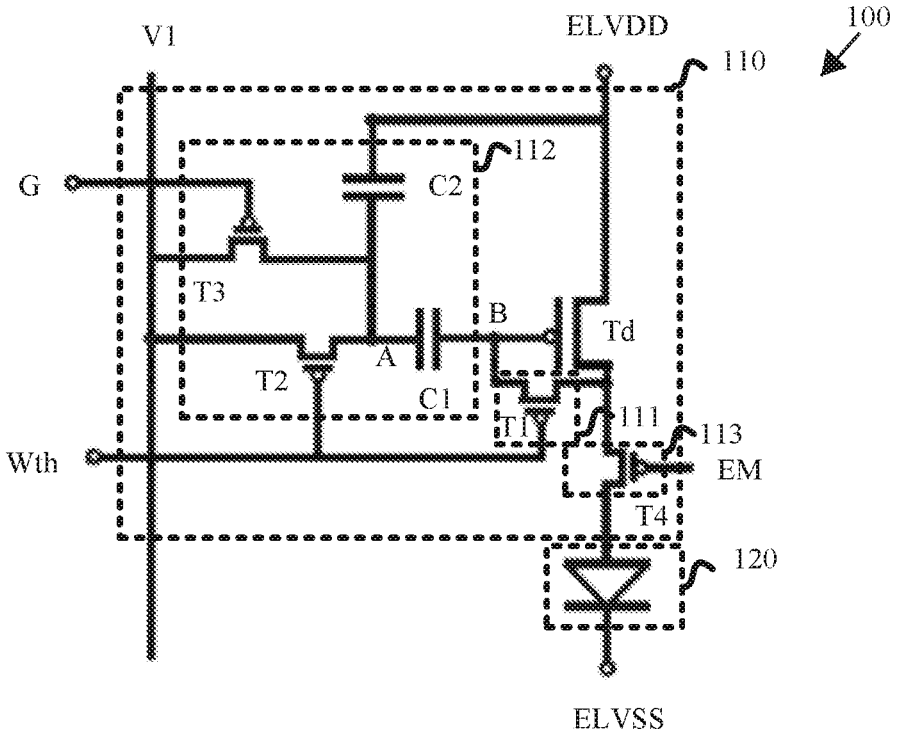
FIG. 2 is an example circuit diagram of a pixel circuit according to an embodiment of the present disclosure.

FIG. 2 shows an example circuit diagram of a pixel circuit 100 according to an embodiment of the present disclosure. As shown in FIG. 2, the reset circuit 111 may include a first transistor T1. A control electrode of the first transistor T1 may be coupled to the first control terminal Wth. A first electrode of the first transistor T1 may be coupled to the second electrode of the drive transistor Td. A second electrode of the first transistor T1 may be coupled to the control electrode of the drive transistor Td.

The compensation and data-in circuit 112 may include a second transistor T2, a third transistor T3, a first capacitor C1, and a second capacitor C2. A control electrode of the second transistor T2 may be coupled to the first control terminal W1. A first electrode of the second transistor T2 may be coupled to the data line V1. A second electrode of the second transistor T2 may be coupled to a first terminal of the first capacitor C1 and a first terminal of the second capacitor C2. A control electrode of the third transistor T3 may be coupled to the second control terminal G. The first electrode of the third transistor T3 may be coupled to the data line V1. A second electrode of the third transistor T3 may be coupled to the first terminal of the second capacitor C2. The second terminal of the first capacitor C1 may be coupled to the control electrode of the drive transistor Td. The second terminal of the second capacitor C2 may be coupled to the first voltage terminal ELVDD.

The light-emitting control circuit 113 may include a fourth transistor T4. The control electrode of the fourth transistor T4 may be coupled to the third control terminal EM. A first electrode of the fourth transistor T4 may be coupled to the light-emitting device 120. A second electrode of the fourth transistor T4 may be coupled to the second electrode of the drive transistor Td.

The light-emitting device 120 may include an organic light emitting diode.

Figure 3:
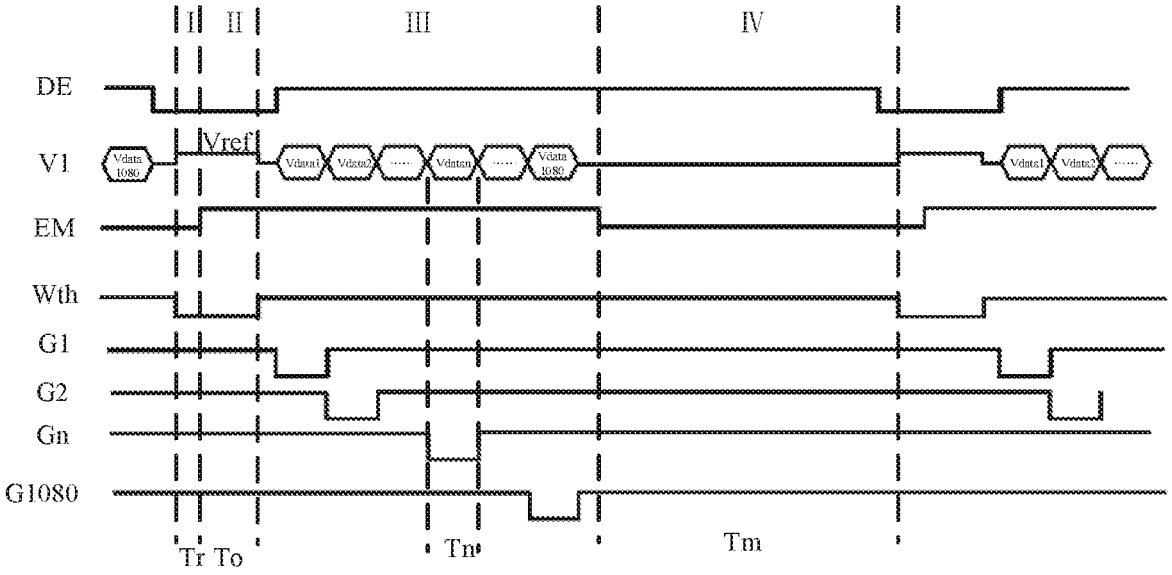
FIG. 3 is a timing diagram of each signal of the pixel circuit as shown in FIG. 2.

FIG. 3 shows a timing diagram of each signal that may be used for the pixel circuit 100 as shown in FIG. 2. In FIG. 3, the phases I to IV represent the time for scanning one frame of image. The working process of the pixel circuit 100 as shown in FIG. 2 will be described in detail below with reference to the timing diagram as shown in FIG. 3. In the following, assuming that all transistors are P-type transistors, the first voltage terminal ELVDD outputs a high level, and the second voltage terminal ELVSS outputs a low level. The above-mentioned high level and low level refer to two preset voltages. Here, the high level has higher voltage than the low level. Those skilled in the art may set the two voltages according to the device selected and the circuit structure adopted, which is not limited by the present disclosure. G1 is used to control the third transistors T3 of the first row of the pixel circuits, so as to provide data Vdata1 to the first row of the pixel circuits. G2 is used to control the third transistors T3 of the second row of the pixel circuits, so as to provide data Vdata2 to the second row of the pixel circuits. Gn is used to control the third transistors T3 of the $n^{th}$ row of the pixel circuits, so as to provide data Vdatan to the $n^{th}$ row of the pixel circuits. G1080 is used to control the third transistors T3 of the $1080^{th}$ row of the pixel circuits, so as to provide data Vdata1080 to the $1080^{th}$ row of the pixel circuits. The second control terminal G in FIG. 2 may correspond to one of G1, G2, . . . , G1080. Here, 1080 represents the total number of rows of the pixel circuits, which is only an example and is not limitative. In addition, DE in FIG. 3 represents a valid data strobe signal from a terminal for transmitting the data signal, which is used for spacing each frame of the data signal. The period in which DE is at a low level indicates a blanking interval, in which no data signal is provided to the pixel circuit. The period in which DE is at a high level indicates a data valid interval, in which a data signal may be provided to the pixel circuit. DE is coupled to a screen driving panel that generates the data signal Vdata and the second control signal G, for providing a reference for the timing of the data signal Vdata and the second control signal G. For example, the rising edge of DE indicates a beginning where the data signal Vdata1 for the first row of the pixel circuits and the second control signal G1 for controlling the first row of the pixel circuits are able to be provided. The beginning of the data signal Vdata1 for the first row of the pixel circuits and the second control signal G1 for controlling the first row of the pixel circuits may start from the rising edge of DE, and it may delay with respect to the rising edge of DE a time period for scanning at most one row.

During the first phase I, V1=Vref, Wth is at the low level, EM is at the low level, and DE is at the low level.

The first control terminal Wth is provided with the low level, thereby enabling the first transistor T1 and the second transistor T2. The data line V1 is provided with the reference signal Vref, thereby starting to apply the reference signal Vref to the first terminal (i.e., point A) of the first capacitor C1. The third control terminal EM is provided with a low level, thereby enabling the fourth transistor T4. Thus, the voltage from the second voltage terminal ELVSS will be applied to the control electrode (i.e., point B) of the drive transistor Td via the light-emitting device 120, the fourth transistor T4, and the first transistor T1. By setting the voltage of the second voltage terminal ELVSS, the voltage of the control electrode of the drive transistor Td may be set to be smaller than the difference between the voltage of the first voltage terminal ELVDD and the absolute value of the threshold voltage of the drive transistor Td. During this phase, the reference signal Vref is used to maintain the voltage of the first terminal of the first capacitor C1. Thus, the voltage of the first terminal of the first capacitor C1 is constant, which is helpful for setting the voltage of the second terminal of the first capacitor C1, thereby resetting the voltage of the control electrode of the drive transistor Td.

Figure 4:
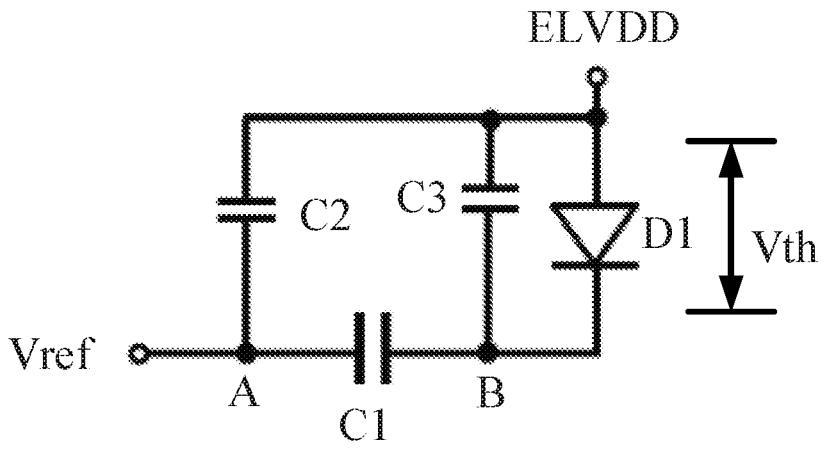
FIG. 4 is an equivalent circuit diagram of the pixel driving circuit in the pixel circuit as shown in FIG. 2 in the second phase.

During the second phase II (the equivalent circuit diagram is shown in FIG. 4), V1=Vref, Wth is at the low level, EM is at the high level, and DE is at the low level.

The third control terminal EM is provided with the high level, thereby disabling the fourth transistor T4. Since the first control terminal Wth remains at the low level, the first transistor T1 and the second transistor T2 continue to be enabled. Since the voltage of the control electrode of the drive transistor Td is set to be smaller than the difference between the voltage of the first voltage terminal ELVDD and the absolute value of the threshold voltage of the drive transistor Td, the drive transistor Td is enabled. Thus, as shown in FIG. 4, the drive transistor Td and the first transistor T1 may be equivalent to a diode D1 and a parasitic capacitor (i.e., gate-source capacitor) C3 of the drive transistor Td which are connected in parallel with each other. Therefore, the voltage of the second terminal (i.e., point B) of the first capacitor C1 is equal to the voltage of the first voltage terminal ELVDD minus the absolute value of the threshold voltage of the drive transistor Td. Since the data line V1 is provided with the reference signal Vref, the voltage of the first terminal (i.e., point A) of the first capacitor C1 is equal to the reference signal Vref. Thus, the amount of charge stored on the first capacitor C1 is Q1=C1×(ELVDD−|Vth|−Vref), the amount of charge stored on the second capacitor C2 is Q2=C2×(ELVDD−Vref), and the amount of charge stored on the parasitic capacitor C3 is Q3=C3×|Vth|. Therefore, the total amount of charge at point B is QB=Q1−Q3=C1×(ELVDD−|Vth|−Vref)−C3×|Vth|.

During this phase, a first compensation voltage ELVDD−|Vth|−Vref associated with the voltage of the first voltage terminal ELVDD, the threshold voltage of the drive transistor Td, and the reference signal Vref is generated in the compensation and data-in circuit 112.

Figure 5:
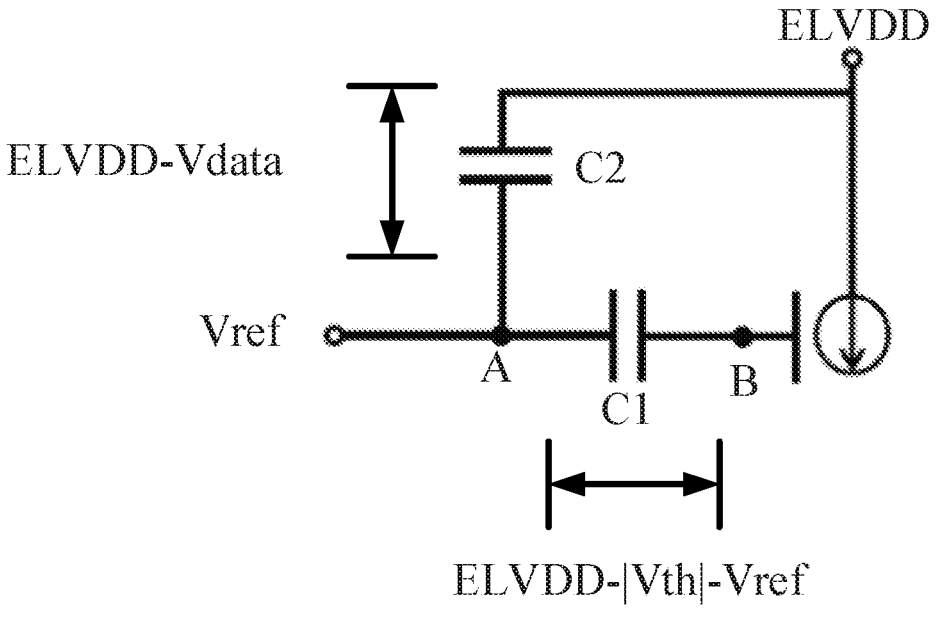
FIG. 5 is an equivalent circuit diagram of the pixel driving circuit in the pixel circuit as shown in FIG. 2 in the third phase.

During the third phase III (i.e., the data-in interval, the equivalent circuit diagram is shown in FIG. 5), V1=Vdata, Wth is at the high level, EM is at the high level, and DE is at the high level.

This phase includes sub-phases of writing data signals Vdata (i.e., Vdata1, Vdata1080) to the pixel circuits in each row respectively.

For example, for the $n^{th}$ row of the pixel circuits (i.e., during the $n^{th}$ sub-phase), the data line V1 is provided with the data signal Vdatan for this row of the pixel circuits. Simultaneously the second control terminal G (Gn for the second control terminal of the $n^{th}$ row of the pixels) of this row of pixel circuits 100 is provided with the low level to enable the third transistor T3, thereby applying data signal Vdata to the first terminal of the second capacitor C2. The first control terminal Wth is provided with the high level, thereby disabling the first transistor T1 and the second transistor T2. Since the first transistor T1 and the second transistor T2 are disabled, the voltage across the both terminals of the first capacitor C1 remains unchanged. Thus, the amount of charge stored on the first capacitor C1 is maintained at Q1=C1×(ELVDD−|Vth|−Vref), and the amount of charge stored on the second capacitor C2 is Q2=C2×(ELVDD−Vdata). Therefore, the total amount of charge at point B is still QB=Q1-Q3=C1×(ELVDD−|Vth|−Vref)−C3×|Vth|, and the total amount of charge at point A is QA=−Q1−Q2=−C1×(ELVDD−|Vth|−Vref)−C2×(ELVDD−Vdata).

During this phase, a third voltage ELVDD-Vdata associated with the voltage of the first voltage terminal ELVDD and the data signal Vdata is generated in the compensation and data-in circuit 112.

Figure 6:
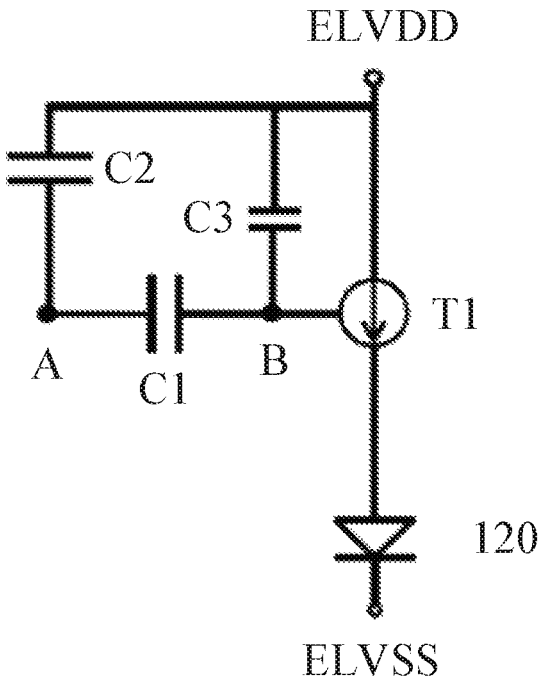
FIG. 6 is an equivalent circuit diagram of the pixel circuit shown in FIG. 2 in the fourth phase.

During the fourth phase IV (i.e., the illumination interval, the equivalent circuit diagram is shown in FIG. 6), Wth is at the high level, EM is at the low level, and DE is at the high level.

The second control terminal G is provided with the high level, thereby disabling the third transistor T3. The third control terminal EM is provided with the low level, thereby enabling the fourth transistor T4. At this time, given that the voltage at point A is VA and the voltage at point B is VB. Then the total amount of charge at point A is Q'A=−C1×(VB−VA)−C2×(ELVDD−VA), and the total amount of charge at point B is QB=C1×(VB−VA)−C3×(ELVDD−VB). Since the amounts of charge at points A and B remain unchanged with respect to the previous phase, respectively, that is, Q'A=QA, Q'B=QB, the voltage at point B may be calculated by:

$$VB = ELVDD - |Vth| + \frac{C1 \times C2}{C1 \times C2 + C2 \times C3 + C3 \times C1}(Vdata - Vref) \quad (1)$$

Substituting the formula (1) into the following formula (2) for calculating the drive current I, the formula (3) may be obtained.

$$I = K(V_{GS} - Vth)^2 \quad (2)$$

$$I = K\left[\frac{C1 \times C2}{C1 \times C2 + C2 \times C3 + C3 \times C1}(Vdata - Vref)\right]^2 \quad (3)$$

In equations (2) and (3), K is a current constant associated with the process parameters and geometrical size of the drive transistor Td.

During this phase, the light-emitting device 120 is driven to emit light according to the voltage of the first voltage terminal ELVDD, the first compensation voltage, and the third voltage. It may be seen from the equation (3) that the drive current I is not related to Vth and ELVDD, and therefore the pixel driving circuit according to the embodiment of the present disclosure can compensate for the threshold voltage Vth of the drive transistor Td and the voltage drops along the power supply line (i.e., the first voltage terminal ELVDD) to avoid their negative effects on the brightness of the light-emitting diodes.

Further, in the embodiment of the present disclosure, during the third phase, the pixel circuits in each row are provided with the data signal Vdata during a time period of about half of a frame (a half of the time period for scanning one frame of image). During the fourth phase, the light-emitting device 120 is driven to emit light within half of a frame. In order to maintain the same brightness as the display panel that drives the light-emitting device to emit light within the time period of one frame, it is necessary to increase the drive current flowing through the drive transistor Td. The drive current flowing through the drive transistor Td may be increased by increasing the voltage range of the data signal Vdata. For example, for a display panel that drives the light-emitting device to emit light within the time period of one frame, by increasing the driving dynamic range of the voltage of the data signal Vdata, the accuracy requirement of the output voltage of the driving IC may be reduced. Further, in an alternative embodiment, in the case where the accuracy of Vdata satisfies the requirement, the drive current flowing through the drive transistor Td may also be increased by reducing the channel length of the drive transistor Td. The reduction of the channel length of the drive transistor Td may reduce the layout area of the pixel circuit, thereby realizing a higher resolution display panel.

Since the first control signal and the third control signal are controlled by the voltage signal, and the first control signal and the third control signal control all the pixels simultaneously, it is not necessary to design a corresponding scanning circuit for the first control signal and the third control signal. In this way, the amount of scanning circuits around the display panel is reduced, which facilitates a designation of the slim bezel of the display panel.

In one example, the reference signal Vref may be provided through the data line V1 during the blanking interval. In other words, the first phase and the second phase described above are in the blanking interval. Thus, it is possible to charge the first capacitor C1 for sufficient time, which may be set as the time for scanning one to dozens of pixel rows. This can increase the charging rate of the first capacitor C1, thereby improving the accuracy of compensating for the threshold voltage Vth of the drive transistor Td.

Those skilled in the art will appreciate that in one embodiment, N-type transistors may also be used to implement the pixel circuit. In this embodiment, the elements in the pixel circuit and their connection manner may be appropriately changed. The first voltage terminal ELVDD can provide the low level, and the second voltage terminal ELVSS may provide the high level. The high and low states of the levels of the first to third control signals are opposite to the levels of the corresponding signals in FIG. 3. For example, the first control signal in FIG. 3 is at the low level during the first phase and the second phase, and the first control signal in this embodiment is at the high level in the first phase and the second phase.

In another alternative embodiment, some of the transistors in the pixel circuit 100 as shown in FIG. 2 may be P-type transistors and others of the transistors may be N-type transistors. The voltages of the first to third control signals used for the pixel circuits in this alternative embodiment are set according to the specific structure of the pixel circuit.

Figure 7:
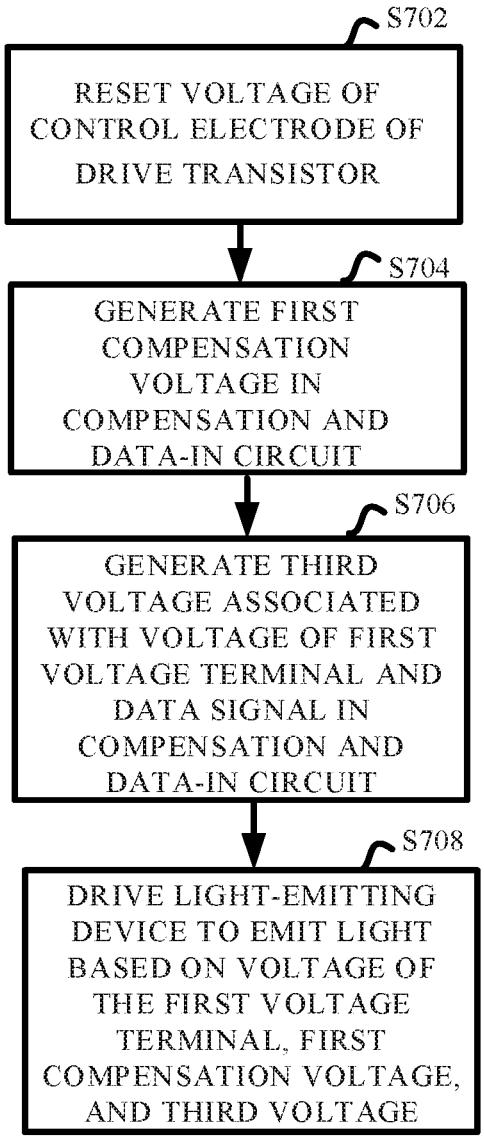
FIG. 7 is a schematic flowchart of a driving method for driving the pixel driving circuit in the pixel circuit as shown in FIG. 1 or FIG. 2 according to an embodiment of the present disclosure.

FIG. 7 is a schematic flowchart of a driving method for driving the pixel driving circuit in the pixel circuit 100 shown in FIG. 1 or FIG. 2 according to an embodiment of the present disclosure.

In the driving method, in step S702, during the first phase, the reference signal Vref is inputted to the data line V1, the second voltage is inputted to the first control terminal Wth and the third control terminal EM, such that the voltage of the control electrode of the drive transistor Td is reset.

In step S704, during the second phase, the second voltage is inputted to the first control terminal Wth, and the first voltage is inputted to the third control terminal EM, such that the first compensation voltage associated with the voltage of the first voltage terminal ELVDD, the threshold voltage of the drive transistor Td and the reference signal Vref is generated in the compensation and data-in circuit 112.

In step S706, during the third phase, the data signal Vdata is inputted to the data line V1, the second voltage is inputted to the second control terminal G, and the first voltage is inputted to the first control terminal Wth, such that the third voltage associated with the voltage of the first voltage terminal ELVDD and the data signal Vdata is generated in the compensation and data-in circuit 112.

In step S708, during the fourth phase, the second voltage is inputted to the third control terminal EM and the first voltage is inputted to the second control terminal G, such that the light-emitting device 120 is driven to emit light based on the voltage of the first voltage terminal ELVDD, the first compensation voltage, and the third voltage.

Figure 8:
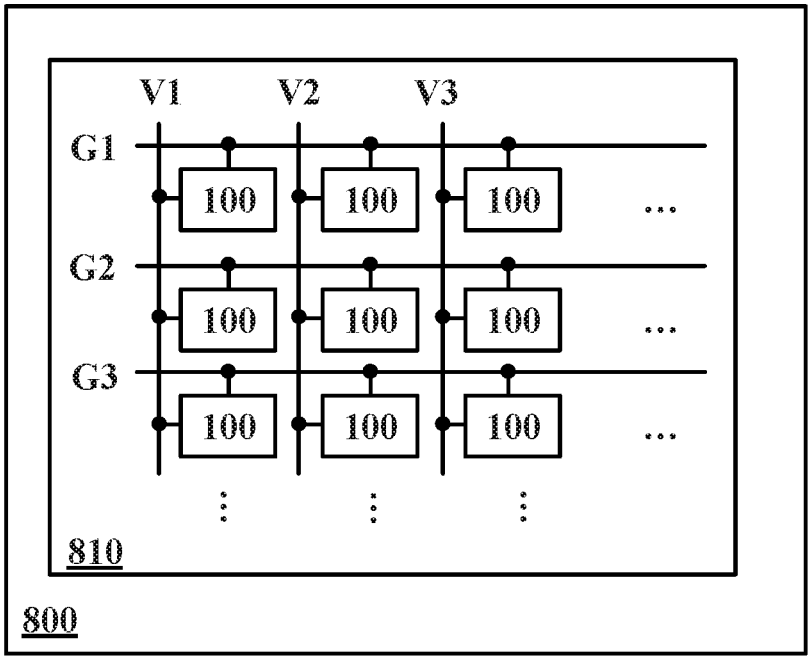
FIG. 8 is a schematic block diagram of a display device according to an embodiment of the present disclosure.

FIG. 8 shows a schematic structural diagram of a display device 800 according to an embodiment of the present disclosure. The display device 800 may include a display substrate 810. The display substrate 810 may include a plurality of gate lines (which are connected to the corresponding second control terminals G1, G2, G3, . . . ) and a plurality of data lines (V1, V2, V3, . . . ) which are intersected with each other. A plurality of pixel circuits 100 as shown in FIG. 1 are arranged in an array. The pixel circuits 100 in the same row are connected to the same gate line, and the pixel circuits 100 in the same column are connected to the same data line. The display device provided by the embodiment of the present disclosure may be applied to any product having a display function, such as an electronic paper, a mobile phone, a tablet computer, a television, a notebook computer, a digital photo frame, a wearable device, or a navigator.

Figure 9:
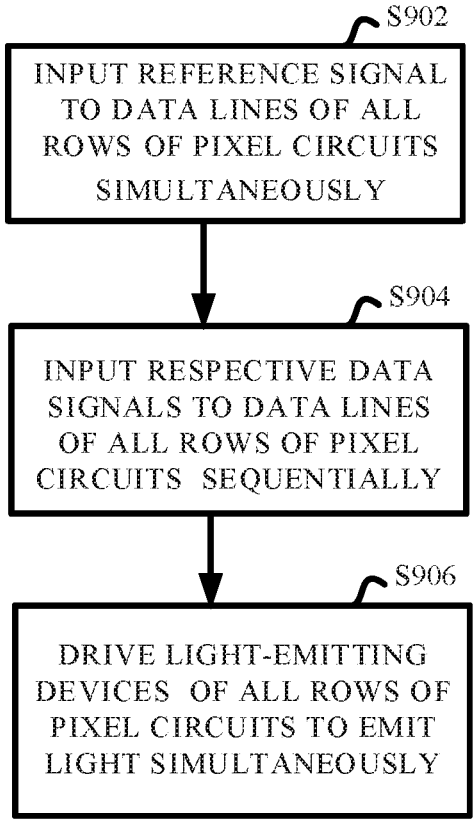
FIG. 9 is a schematic flowchart of a driving method for driving the display device shown in FIG. 8 according to an embodiment of the present disclosure.

FIG. 9 is a schematic flowchart of a driving method for driving the display device 800 as shown in FIG. 8 according to an embodiment of the present disclosure.

In the driving method, in step S902, during the blanking interval, the reference signal Vref is inputted to the data lines of all rows of the pixel circuits 100, (V1, V2, V3, . . . ) simultaneously, to perform steps S702 and S704 in FIG. 7 for all the pixel circuits 100.

In step S904, during the data-in interval, the respective data signals Vdata are inputted to the data lines of all rows of the pixel circuits 100 sequentially, to perform step S706 in FIG. 7 for pixel circuits 100 in the corresponding row.

In step S906, during the light-emitting interval, step S708 in FIG. 7 is performed to drive the light-emitting devices 120 of all rows of the pixel circuits 100 to emit light simultaneously. The light-emitting device 120 is driven to emit light for less than a half of the time period for scanning one frame of image.

As used herein and in the appended claims, the singular form of a word includes the plural, and vice versa, unless the context clearly dictates otherwise. Thus, singular words are generally inclusive of the plurals of the respective terms. Similarly, the words "include" and "comprise" are to be interpreted as inclusively rather than exclusively. Likewise, the terms "include" and "or" should be construed to be inclusive, unless such an interpretation is clearly prohibited from the context. Where used herein the term "examples," particularly when followed by a listing of terms is merely exemplary and illustrative, and should not be deemed to be exclusive or comprehensive.

Further adaptive aspects and scopes become apparent from the description provided herein. It should be understood that various aspects of the present disclosure may be implemented separately or in combination with one or more other aspects. It should also be understood that the description and specific embodiments in the present disclosure are intended to describe rather than limit the scope of the present disclosure.

A plurality of embodiments of the present disclosure has been described in detail above. However, apparently those skilled in the art may make various modifications and variations on the embodiments of the present disclosure without departing from the spirit and scope of the present disclosure. The scope of protecting of the present disclosure is limited by the appended claims.

What is claimed is:

1. A pixel driving circuit comprising a reset circuit, a compensation and data-in circuit, a drive transistor, and a light-emitting control circuit, wherein the reset circuit is coupled to a first control terminal, a control electrode of the drive transistor, and a second electrode of the drive transistor, and is configured to reset a voltage of the control electrode of the drive transistor, according to a first control signal from the first control terminal and a third control signal from a third control terminal;

wherein the compensation and data-in circuit is coupled to a data line, the first control terminal, a second control terminal, the control electrode of the drive transistor, and a first voltage terminal, and is configured to receive a reference signal from the data line according to the first control signal, receive a data signal from the data line according to a second control signal from the second control terminal, and apply a compensation voltage to the control electrode of the drive transistor based on the reference signal, the data signal, and a voltage of the first voltage terminal;

wherein the control electrode of the drive transistor is coupled to the compensation and data-in circuit, wherein a first electrode of the drive transistor is coupled to the first voltage terminal, and wherein the second electrode of the drive transistor is coupled to the light-emitting control circuit; and wherein the light-emitting control circuit is coupled to a light-emitting device and the third control terminal, and is configured to control the light-emitting device to emit light according to the third control signal.

2. The pixel driving circuit according to claim 1, wherein the reset circuit comprises a first transistor, wherein a control electrode of the first transistor is coupled to the first control terminal, wherein a first electrode of the first transistor is coupled to the second electrode of the drive transistor, and wherein a second electrode of the first transistor is coupled the control electrode of the drive transistor.

3. The pixel driving circuit according to claim 2, wherein the compensation and data-in circuit comprises a second transistor, a third transistor, a first capacitor, and a second capacitor, wherein a control electrode of the second transistor is coupled to the first control terminal, wherein a first electrode of the second transistor is coupled to the data line, and wherein a second electrode of the second transistor is coupled to a first terminal of the first capacitor and a first terminal of the second capacitor;

wherein a control electrode of the third transistor is coupled to the second control terminal, wherein a first electrode of the third transistor is coupled to the data line, and wherein a second electrode of the third transistor is coupled to the first terminal of the second capacitor;

wherein a second terminal of the first capacitor is coupled to the control electrode of the drive transistor; and wherein a second terminal of the second capacitor is coupled to the first voltage terminal.

4. The pixel driving circuit according to claim 1, wherein the compensation and data-in circuit comprises a second transistor, a third transistor, a first capacitor, and a second capacitor, wherein a control electrode of the second transistor is coupled to the first control terminal, wherein a first electrode of the second transistor is coupled to the data line, and wherein a second electrode of the second transistor is coupled to a first terminal of the first capacitor and a first terminal of the second capacitor;

wherein a control electrode of the third transistor is coupled to the second control terminal, wherein a first electrode of the third transistor is coupled to the data line, and wherein a second electrode of the third transistor is coupled to the first terminal of the second capacitor;

wherein a second terminal of the first capacitor is coupled to the control electrode of the drive transistor; and wherein a second terminal of the second capacitor is coupled to the first voltage terminal.

5. The pixel driving circuit according to claim 1, wherein the light-emitting control circuit comprises a fourth transistor, wherein a control electrode of the fourth transistor is coupled to the third control terminal, wherein a first electrode of the fourth transistor is coupled to the light-emitting device, and wherein a second electrode of the fourth transistor is coupled to the second electrode of the drive transistor.

6. The pixel driving circuit according to claim 1, wherein the reference signal is provided by the data line in a blanking interval.

7. A pixel circuit comprising the pixel driving circuit according to claim 1 and a light-emitting device, wherein the pixel driving circuit is connected to one terminal of the light-emitting device and is configured to drive the light-emitting device to emit light, and wherein another terminal of the light-emitting device is connected to a second voltage terminal.

8. The pixel circuit according to claim 7, wherein the light-emitting device comprises an organic light-emitting diode.

9. A display substrate comprising:

a plurality of gate lines and a plurality of data lines; and a plurality of pixel circuits according to claim 7, which are arranged in an array, wherein each of the gate lines is coupled to a second control terminal of the respective pixel circuit.

10. A display device comprising the display substrate according to claim 9.

11. A driving method for driving the display device according to claim 10, the driving method comprising:

inputting a reference signal to the data lines of all rows of the pixel circuits simultaneously;

inputting the respective data signals to the data lines of all rows of the pixel circuits sequentially; and driving the light-emitting devices of all rows of the pixel circuits to emit light simultaneously, wherein the light-emitting device is driven to emit light for less than a half of a time period for scanning one frame of image.

12. The driving method according to claim 11, wherein the time period for scanning one frame of image comprises three different intervals:

a blanking interval, a data-in interval, and a light-emitting interval;

wherein in the blanking interval, the reference signal is simultaneously inputted to the data lines of all rows of the pixel circuits;

wherein in the data-in interval, the respective data signals are sequentially inputted to the data lines of all rows of the pixel circuits; and wherein in the light-emitting interval, the light-emitting devices of all rows of the pixel circuits are driven to emit light simultaneously.

13. A driving method for driving the pixel driving circuit according to claim 1, the driving method comprising:

inputting a reference signal to the data line, and generating, in the compensation and data-in circuit, a first compensation voltage associated with a voltage of the first voltage terminal, a threshold voltage of the drive transistor, and the reference signal;

inputting a data signal to the data line, inputting a second voltage to the second control terminal, and inputting a first voltage to the first control terminal, so as to generate, in the compensation and data-in circuit, a third voltage associated with the voltage of the first voltage terminal and the data signal; and inputting the second voltage to a third control terminal and inputting the first voltage to the second control terminal, so as to drive the light-emitting device to emit light based on the voltage of the first voltage terminal, the first compensation voltage, and the third voltage.

14. The driving method according to claim 13, wherein the inputting the reference signal to the data line, and generating, in the compensation and data-in circuit, the first compensation voltage comprises:

inputting the reference signal to the data line, and inputting the second voltage to the first control terminal and the third control terminal, so as to reset the voltage of the control electrode of the drive transistor; and inputting the second voltage to the first control terminal, and inputting the first voltage to the third control terminal, so as to generate the first compensation voltage in the compensation and data-in circuit.

15. The driving method according to claim 14, wherein in the blanking interval, the reference signal is input to the data line, and the first compensation voltage is generated in the compensation and data-in circuit.

16. The driving method according to claim 13, wherein the voltage of the control electrode of the drive transistor is reset to a voltage smaller than a difference between the voltage of the first voltage terminal and an absolute value of the threshold voltage of the drive transistor.

17. A pixel driving circuit comprising a drive transistor, a first transistor, a second transistor, a third transistor, a fourth transistor, a first capacitor, and a second capacitor, wherein a control electrode of the drive transistor is coupled to a second electrode of the first transistor and a second terminal of the first capacitor, wherein a first electrode of the drive transistor is coupled to a first voltage terminal and a second terminal of the second capacitor, and wherein a second electrode of the drive transistor is coupled to a first electrode of the first transistor and a second electrode of the fourth transistor;

wherein a control electrode of the first transistor is coupled to a first control terminal;

wherein a control electrode of the second transistor is coupled to the first control terminal, wherein a first electrode of the second transistor is coupled to a data line, and wherein a second electrode of the second transistor is coupled to a first terminal of the first capacitor and a first terminal of the second capacitor;

wherein a control electrode of the third transistor is coupled to a second control terminal, wherein a first electrode of the third transistor is coupled to the data line, and wherein a second electrode of the third transistor is coupled to the first terminal of the second capacitor; and wherein a control electrode of the fourth transistor is coupled to a third control terminal, and wherein a first electrode of the fourth transistor is coupled to a light-emitting device.

18. The pixel driving circuit according to claim 17, wherein the data line is configured to receive a reference signal and a data signal in different intervals.

19. The pixel driving circuit according to claim 18, wherein a current flowing through the drive transistor when the light-emitting device is emitting light is expressed as:

$$I = K\left[\frac{C1 \times C2}{C1 \times C2 + C2 \times C3 + C3 \times C1}(Vdata - Vref)\right]^2$$

where I represents the current flowing through the drive transistor, K represents a current constant associated with the drive transistor, C1 represents a capacitance value of the first capacitor, C2 represents a capacitance value of the second capacitor, C3 represents a capacitance value of a parasitic capacitor of the drive transistor, Vdata represents a voltage value of a data signal from the data line, and Vref represents a voltage value of a reference signal from the data line.

20. The pixel driving circuit according to claim 17, wherein the drive transistor, the first transistor, the second transistor, the third transistor, and the fourth transistor are P-type transistors.

* * * * *